United States Patent [19]

Fälchle

[11] Patent Number: 4,826,363

[45] Date of Patent: May 2, 1989

[54] FACE-MILLING CUTTER FOR A PLANER

[75] Inventor: Karl-Heinz Fälchle, Oberkochen, Fed. Rep. of Germany

[73] Assignee: Gebr. Leitz GmbH & Co., Oberkochen, Fed. Rep. of Germany

[21] Appl. No.: 84,206

[22] Filed: Aug. 12, 1987

[30] Foreign Application Priority Data

Aug. 27, 1986 [DE] Fed. Rep. of Germany ..... 3829157

[51] Int. Cl.[4] ..... B26D 1/12

[52] U.S. Cl. ..... 407/40; 407/62; 407/63; 407/53

[58] Field of Search ..... 407/40, 41, 42, 51, 407/52, 59, 60, 61, 62, 63, 65

[56] References Cited

U.S. PATENT DOCUMENTS

| | | | |
|---|---|---|---|
| 2,188,743 | 1/1940 | Severson | 407/63 |
| 2,212,012 | 8/1940 | Davidson | 407/63 |
| 3,551,978 | 1/1971 | Barry, Jr. | 407/40 |
| 3,785,417 | 1/1974 | Vora | 407/59 |
| 4,485,858 | 12/1984 | Cecchi | 407/63 |
| 4,541,756 | 9/1985 | Kubota | 407/63 |

OTHER PUBLICATIONS

Advertising Leaflet of WIGO, Wilhelm Groupp Werkzeug-und Maschinenfaubrik, no date.

*Primary Examiner*—Frederick R. Schmidt
*Assistant Examiner*—Blynn Shideler
*Attorney, Agent, or Firm*—Dickstein, Shapiro & Morin

[57] ABSTRACT

In a milling cutter, particularly a planer face-milling cutter having at least one blade arranged in a groove of the cylindrical milling cutter body, which blade has a spiral shaped cutting edge, both the sides of the groove which runs at an angle greater than zero degrees relative to the longitudinal axis of the milling cutter body and the side surfaces of the blade to be secured in the groove are planar parallel surfaces. The edge forming the cutting edge of the blade is bulged over the entire length of the blade to provide a uniform spacing above the outer peripheral surface of the milling cutter body. The spiral shape of the cutting edge of the blade is formed by a corresponding ground surface on the edge zone of the blade forming the cutting edge.

7 Claims, 2 Drawing Sheets

6
7
9
10
11
12
106
107
109
109'
112
IV
V
VI
VIII
IX
X

FACE-MILLING CUTTER FOR A PLANER

BACKGROUND OF THE INVENTION

The present invention relates to a milling cutter, particularly a planar face-milling cutter, having at least one cutter-blade arranged in a groove of the cylindrical body of the milling cutter, which cutter-blade has a cutting edge formed in a curved shape.

Because milling cutters which have cutter-blades lying in a plane including the longitudinal axis of the milling head support or parallel thereto cause a great deal of noise, particularly when idling, milling cutters have already been suggested with cutter-blades having so-called spiral cutting edges. The advantageous noise reduction achieved in this manner, however, it offset by a substantially increased manufacturing expense, because both the cutter-blades and the sides of the grooves in which the blades lie must have a curved shape.

SUMMARY AND OBJECTS OF THE INVENTION

It is an object of the invention, therefore, to create a milling cutter, particularly a planer face-milling cutter, having a so-called spiral cutting edge in which the manufacture of the body of the milling cutter and the clamping element and the cutter-blade or blades can be accomplished in a simple and cost-effective manner.

Because the sides of the groove or grooves provided in the body of the milling cutter run parallel to each other and are planar surfaces, the groove can be milled or broached economically. The embodiment of the cutter-blades as plane plates also contributes substantially to the cost-effectiveness of the manufacturing. The bulging of the edge of the plate forming the cutting edge can thus be performed with little expense. Furthermore, the grinding of the cutting edges, by means of which they obtain their curved shape, is not expensive, because special grinding machines can be used for this purpose. The milling cutter of the present invention therefore makes it possible, in a cost-effective manner relative to known milling cutters having straight-line cutting edges, to substantially reduce both noise and cutting forces and to improve the finished surface quality.

It is also advantageous to select the thickness of the cutter-blade according to the value necessary for the spiral chipping face-surface grinding and flank-surface grinding. A minimum thickness is achieved in this manner when the cutting edge at the two ends of the blade lies at least approximately in the one side surface determining the blade thickness, and at the midpoint of the blade length it lies at least approximately in the other side surface.

In order to obtain good chip removal, it is advantageous to provide the spirally ground chipping face-surface with the shape of a chip deflector.

Due to the construction of the groove and cutting-blade according to the invention, the clamping element, which advantageously lies in the groove together with the blade for the purpose of securing same, can have parallel planar side surfaces, which also keep its manufacturing cost low. In order to apply equal clamping force over the entire length of the blade, the clamping element is bulged on its upper side similar to the blade. A recess is made in this upper side to form a chip chamber adjoining the clipping face-surface of the blade for significantly improving chip removal.

If the body of the cutter has more than one groove, then these grooves generally will be uniformly distributed around the periphery of the body of the milling cutter.

In the solution according to the invention, each cutter-blade can be formed in a simple manner to be reversible, whereby the two cutting edges are advantageously arranged symmetrically to the longitudinal center axis of the blade and the commonly provided positioning guides for the blades are also located in the longitudinal center axis thereof. The blades can be reversed without additional auxiliary means after the clamping element is released.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
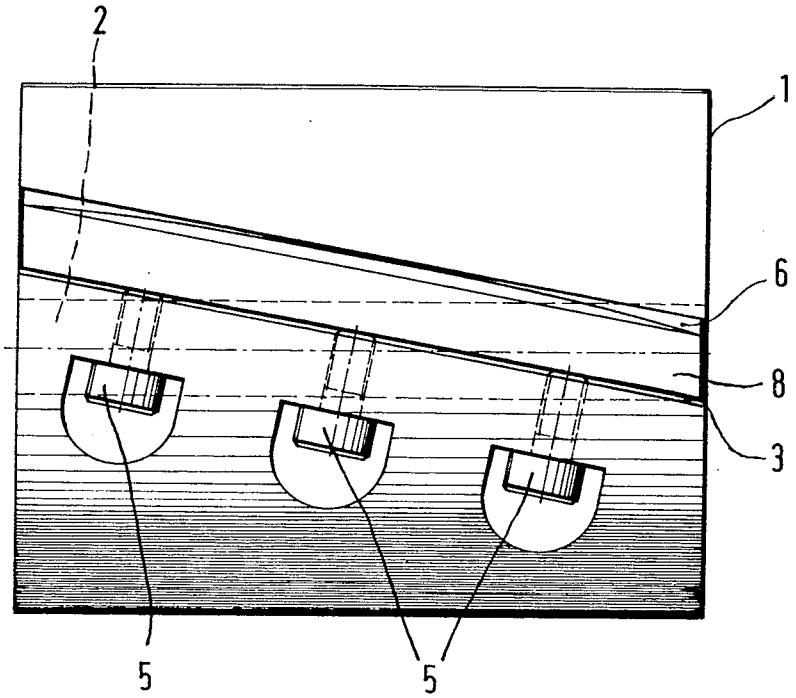
FIG. 1 is a view of a first preferred embodiment with a view toward the outer peripheral surface of the milling cutter body.

A cylindrical milling cutter body 1 for a planer milling cutter (not shown) has, in addition to a central bore 2, which receives the drive shaft, a groove 3 which penetrates inward from the outer peripheral surface and is formed by milling or broaching. As shown in FIG. 1, the longitudinal axis of the groove 3 forms an acute angle with the longitudinal axis of the body 1 of the milling cutter, which angle, for example, may be about 10 degrees. Despite its angular position, the groove 3 has planar sides 4 which run parallel to each other. In the longitudinal direction of the groove, spaced threaded bores penetrate from the outer peripheral surface of the milling cutter body 1 into the groove 3 in such a manner that their longitudinal axes lie at a right angle to the longitudinal direction of the groove. The threaded bores are not perpendicular to the sides 4, but rather are inclined relative to the groove base. A clamping screw 5 is threaded into each of these threaded bores.

A cutter-blade, designated generally with the reference numeral 6, has the shape of a plane plate. One of the two planar and parallel side surfaces 7 of the cutter-blade 6 lies against one side 4 of the groove 3. The blade thickness is determined by the distance between the two planar side surfaces. At the other side surface 7 there is a bar-like clamping element 8. The clamping element 8 is pressed by the clamping screws 5 against the blade 6, whereby screw ends, together with the side 4, which serves as an abutment for the blade 6, form a wedge, which secures the blade 6 and the clamping element 8 in the intended position. The clamping element 8, like the blade 6, has planar side surfaces running parallel to each other and is therefore a very simply structural component.

Figures 3, 4, 5, 6, 7, 8, 9, 10:
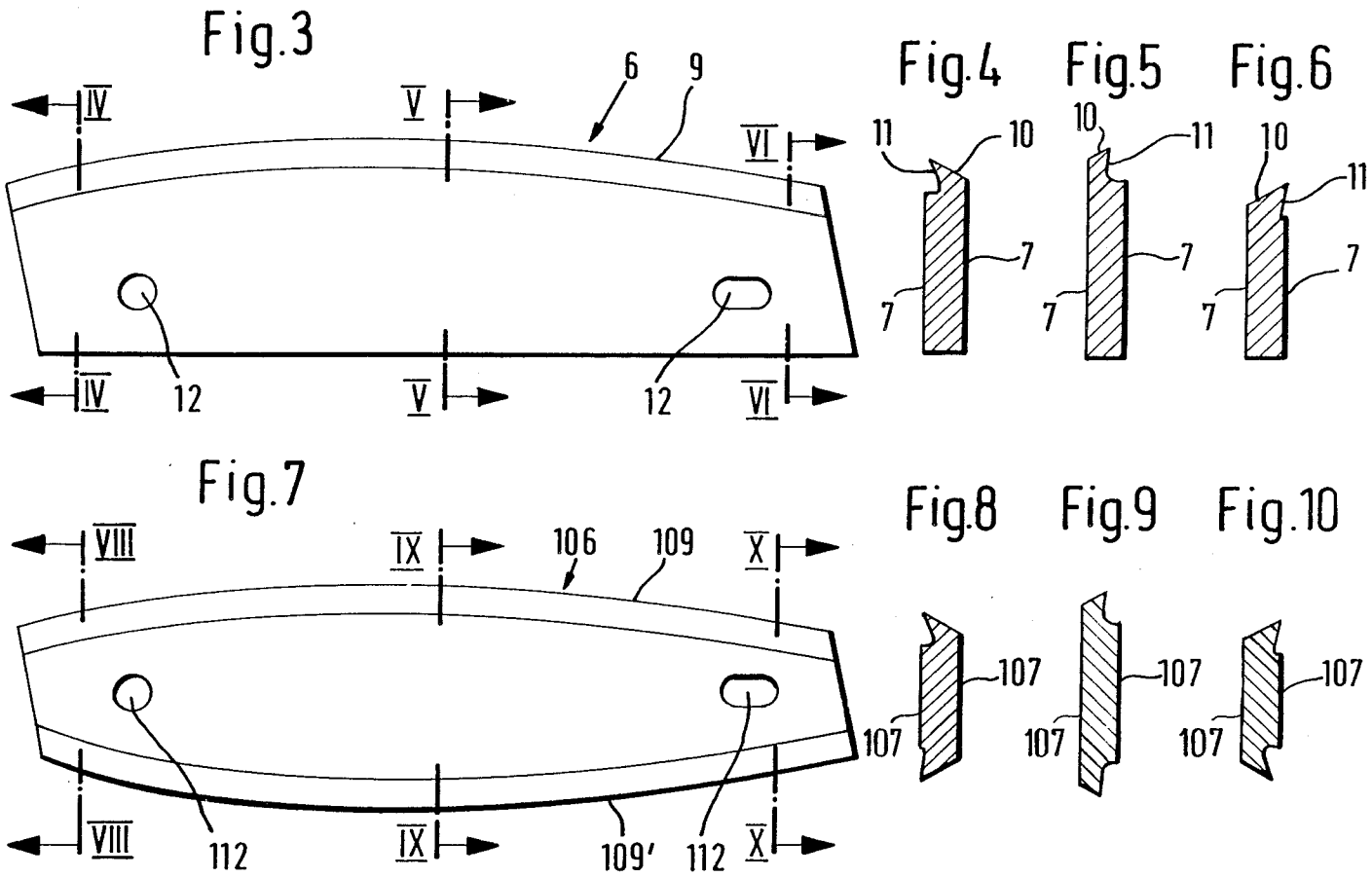
FIG. 3 is a view of the cutter-blade of the first preferred embodiment.
FIG. 4 is a section according to the line IV—IV in FIG. 3.
FIG. 5 is a section according to the line V—V in FIG. 3.
FIG. 6 is a section according to the line VI—VI in FIG. 3.
FIG. 7 is a view of the cutter-blade of a second preferred embodiment.
FIG. 8 is a section according to the line VIII—VIII in FIG. 7.
FIG. 9. is a section according to the line IX—IX in FIG. 7.
FIG. 10 is a section according to line X—X in FIG. 7.

In order to be sure that the blade 6, which extends from one frontal surface of the milling cutter body 1 to the other, is equally distant above the outer peripheral surface of the milling cutter body 1 over its entire length, which is a prerequisite to obtain a plane surface on the piece to be worked, the blade 6 is bulged to an appropriate degree along the edge forming the cutting edge 9, as clearly illustrated in FIG. 3.

As shown in FIG. 1, the cutting edge 9 has a spiral shape. At the left end of the blade, as viewed in FIG. 1, the cutting edge 9 lies at least approximately at the side surface 7 facing the clamping element 8. As viewed in FIG. 4, edge 9 lies approximately at the side surface 7 facing the clamp. At the midpoint of the blade 6, the cutting edge 9 lies at least approximately near the other side surface 7, as also shown in FIG. 5, edge 9 lies near the other side faces 7, and runs from here back toward the side surface 7 facing the clamping element 8. Also also shown in FIG. 6, edge 9 lies approximately at the side surface 7 facing the clamp. The thickness of the blade 6 in this preferred embodiment can in this manner be selected to be only slightly larger than the maximum deviation of the cutting edge 9 from the plane defined by the two blade sides.

The cutting edge 9 is formed by the ground surfaces between the flank-surface 10 and the chipping face-surface 11, both of which have a spiral shape. In order to have approximately equal cutting relationships over the entire length of the edge 9, the flank-surface 10 and the chipping face-surface 11 are formed in such a manner that over the entire length of the blade both the clearance angle and the rake angle are at least approximately constant. As shown by FIGS. 4 through 6, this results in the angle formed by the flank-surface 10 relative to the side surfaces 7 and the angle formed by the chipping face-surface 11, changing over the longitudinal direction of the blade.

Figure 2:
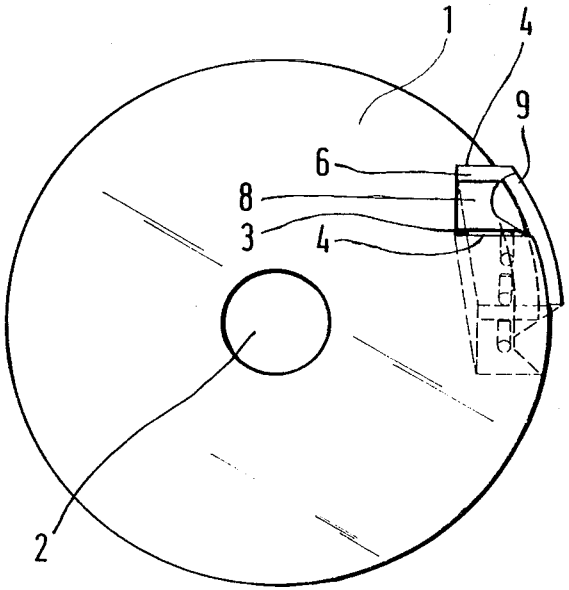
FIG. 2 is a front view of the first preferred embodiment.

The chipping face-surface 11 is made in such a manner that a chip deflector surface is provided for the removal of the chips As shown in FIG. 2, a chip chamber formed by the clamping element 8 adjoins this chip deflector surface. For this purpose, the clamping element 8 has a recess adjoining the chip deflector surface on its outward side. Due to the bulging of the blade 6 along the edge zone forming the cutting edge 9, the clamping element 8 is also bulged appropriately.

As shown in FIG. 3, the blade 6 is provided with two openings 12 which engage the two securing pins of the clamping element 8.

The second embodiment, of which only the blade 106 is illustrated, differs from the above-described preferred embodiment only in that the blade 106 is formed so as to be reversible, i.e. it also has a second cutting edge 109′ in addition to the cutting edge 109 which corresponds to the cutting edge 9 of the blade 6. The cutting edge 109′ has the same spiral shape as the edge 109. As shown in FIGS. 8–10, at one side of the blade cutting edges 109 and 109′ lie approximately at the side surface 10 facing the clamp 109 and 109′ lie near the other side surface 107 (FIG. 9). While at the other side of the blade cutting edges 109 and 109′ again lie approximately at the side surface 107 facing the clamp (FIG. 10). In other respects, the edge of the blade 106 which forms the cutting edge 109′ is constructed in the same manner as the edge which forms the cutting edge 109, so that when the blade 106 is reversed, precisely the same cutting relationships result as with the cutting edge 109. During the reversal, the blade 106 is rotated about both its longitudinal axis and its lateral axis. The openings 112 corresponding to the openings 12 lie along the longitudinal center axis of the blade 106, to assure that the same positioning for both cutting edges 109 and 109′.

As shown in FIGS. 8 through 10, the cutting edge 109′ also has a clearance angle and rake angle that remain approximately equal over the entire length of the blade, thus causing the position of the flank-surface and the chipping face-surface to change relative to the side surfaces 107 over the length of the blade. This change occurs oppositely for the two cutting edges 109 and 109′.

Independently of whether the blade has only a single cutting edge or is formed to be reversible, all available cutting materials can be used. Accordingly, super high-speed blades or carbide blades can be used, and also as replacements, by exchanging the blades.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A planar face-milling cutter having at least one cutting blade having a curved cutting edge and secured in a groove in the cylindrical milling cutter body of said face milling cutter, comprising:

(a) a groove, having parallel sides and formed in said cylindrical milling cutter body at a nonparallel angle to the longitudinal axis of the milling head body;

(b) a cutting blade having parallel planer side faces and being fixed in said groove;

(c) said cutting blade having an edge which forms the cutting edge of said cutting blade, said cutting edge being bulged over the entire length of said cutting blade in order to provide uniform spacing above the outer peripheral surface of said milling cutter body;

(d) said cutting edge further having a curved shape formed by a corresponding ground surface of an edge zone of said cutting blade which forms said cutting edge;

(e) said cutting edge of said cutting blade having clearance and rake angles which remain approximately equal over the entire length of said cutting blade; and (f) said cutting edge further having a spiral shape varying over its length such that at either end said cutting edge lies approximately at one parallel planar side face, while at the approximate midpoint of said cutting blade, said cutting edge lies approximately near the other parallel planar side face.

2. The planer face-milling cutter of claim 1, wherein the thickness of the cutting blade is selected in accordance with the value required for the curved shaped ground face-surface and a ground flank-surface.

3. The planer face-milling cutter of claim 2, wherein said curved shape ground face-surface has the shape of a chip deflector in order to assist in the removal of chips.

4. The planer face-milling cutter of claim 3, further comprising clamping means arranged for securing the cutting blade in the groove, said clamping means having parallel, planar side surfaces and an upper side similarly bulged to the bulging of said cutting blade, said clamping means further having a recess adjoining the ground face-surface of the cutting blade which forms a chip chamber.

5. The planer face-milling cutter of claim 1, wherein said cutting blade has a longitudinal center axi and is formed as a reversible blade having at least two cutting edges arranged symmetrically to said longitudinal center axis of said blade and further comprises positioning means located in said longitudinal cener axis.

6. The planer face-milling cutter of claim 1, wherein said cutting blade has a longitudinal center axis and is formed as a reversible blade having at least two cutting edges arranged pointsymmetrically to the center of said longitudinal center axis and further comprises positioning means located in said longitudinal center axis.

7. A planer face-milling cutter having at least one cutting blade having a curved cutting edge and secured in a groove in the cylindrical milling cutter body of said facemilling cutter, comprising:

(a) a groove, having parallel sides and formed in said cylindrical milling cutter body at a nonparallel angle to the longitudinal axis of the milling head body;

(b) a cutting blade having parallel planer side faces and being fixed in said groove;

(c) said cutting blade having an edge which forms the cutting edge of said cutting blade, said cutting edge being bulged over the entire length of said cutting blade in order to provide uniform spacing above the outer peripheral surface of said milling cutter body;

(d) said cutting edge further having a curved shape formed by a corresponding ground surface of an edge zone of said cutting blade which forms said cutting edge;

(e) said cutting edge of said cutting blade having clearance and rake angles which remain at least approximately equal over the entire length of said cutting blade; and (f) said cutting edge further having a spiral shape varying over its length such that at either end said cutting edge lies approximately at one parallel planar side face, while at the approximate midpoint of said cutting blade, said cutting edge lies approximately near the other parallel planar side face.

* * * * *

UNITED STATES PATENT AND TRADEMARK OFFICE

CERTIFICATE OF CORRECTION

PATENT NO. : 4,826,363

DATED : May 2, 1989

INVENTOR(S) : Karl-Heinz Fälchle

It is certified that error appears in the above-identified patent and that said Letters Patent is hereby corrected as shown below:

On the face of the patent in the Foreign Application Priority Data Section, please replace "3829157" with --3629157--.

On the face of the patent in the Other Publications Section, please replace "Groupp" with --Grupp-- and "Maschinenfaubrik" with --Maschinenfabrik--.

In the Background of the Invention:

In Column 1, line 6, please replace "planar" with --planer--, and line 17, please replace "it" with --is--.

In Summary and Objects of the Invention:

In Column 2, line 1, please replace "clipping" with --chipping--.

In Brief Description of the Drawings:

In Column 2, line 41, please add --and--.

In Detailed Description of the Preferred Embodiment:

In Column 3, line 11, please replace "simply" with --simple--, line 29, please replace "here" with --there-- and line 52, place a --.-- after chips.

In Column 4, line 2, please replace "10" with --107--, line 3, after "clamp" please insert --(FIG. 8). At the approximate midpoint of the blade cutting edges--.

UNITED STATES PATENT AND TRADEMARK OFFICE

CERTIFICATE OF CORRECTION

PATENT NO. : 4,826,363

DATED : May 2, 1989

INVENTOR(S) : Karl-Heinz Falchle

It is certified that error appears in the above-identified patent and that said Letters Patent is hereby corrected as shown below:

In What is Claimed is:

In Column 4, line 39, please replace "planar" with --planer--.

Signed and Sealed this

First Day of January, 1991

*Attest:*

HARRY F. MANBECK, JR.

*Attesting Officer*

*Commissioner of Patents and Trademarks*